US010232916B1

(12) United States Patent
Efstathiou

(10) Patent No.: US 10,232,916 B1
(45) Date of Patent: Mar. 19, 2019

(54) BARGE CHOCKING SYSTEM

(71) Applicant: Peck & Hale, L.L.C., West Sayville, NY (US)

(72) Inventor: Christos Efstathiou, Merrick, NY (US)

(73) Assignee: Peck & Hale, L.L.C., West Sayville, NY (US)

( * ) Notice: Subject to any disclaimer, the term of this patent is extended or adjusted under 35 U.S.C. 154(b) by 149 days.

(21) Appl. No.: 15/455,605

(22) Filed: Mar. 10, 2017

Related U.S. Application Data

(60) Provisional application No. 62/306,115, filed on Mar. 10, 2016.

(51) Int. Cl.
*B63B 25/24* (2006.01)
*B63B 25/28* (2006.01)

(52) U.S. Cl.
CPC ..... *B63B 25/28* (2013.01); *B63B 25/24* (2013.01)

(58) Field of Classification Search
CPC .... B63B 25/24; B63B 25/28; B63B 2025/285
See application file for complete search history.

(56) References Cited

U.S. PATENT DOCUMENTS

| | | | | | |
|---|---|---|---|---|---|
| 2,411,900 | A * | 12/1946 | Seward | B63B 25/24 | 248/354.7 |
| 2,817,212 | A * | 12/1957 | Stubbs | E02B 17/00 | 405/209 |
| 3,171,627 | A * | 3/1965 | Tapley | B63B 25/24 | 248/188.5 |
| 3,738,434 | A * | 6/1973 | Nelson | E21B 7/124 | 166/355 |
| 4,147,123 | A * | 4/1979 | Kirby | B63B 25/006 | 114/260 |

FOREIGN PATENT DOCUMENTS

| | | | | |
|---|---|---|---|---|
| DE | 2635374 A1 * | 2/1978 | | B60P 7/13 |
| DE | 3939225 A1 * | 5/1991 | | B63B 25/28 |
| DE | 19533066 B4 * | 6/2006 | | B63B 25/004 |
| GB | 2392665 A * | 3/2004 | | B65D 88/129 |
| WO | WO-2008097095 A1 * | 8/2008 | | B63B 25/24 |

* cited by examiner

*Primary Examiner* — Hilary L Gutman
(74) *Attorney, Agent, or Firm* — Schroeder Law PC

(57) ABSTRACT

A chocking system, which is both removable and readily adjustable, for providing additional transverse restraint to cargo during transit. The chocking system may be utilized when the size and weight of the cargo requires additional restraints beyond the typical lashing gear, for example, the transportation of barges on a ship.

11 Claims, 5 Drawing Sheets

BARGE CHOCKING SYSTEM

This application claims the benefit of U.S. Provisional Application Ser. No. 62/306,115, filed Mar. 10, 2016.

BACKGROUND OF THE INVENTION

The present invention relates to a barge chocking system and, more particularly, to a removable and adjustable system for providing additional transverse restraint to cargo during transit.

Transportation of cargo requires securing systems which include devices that ensure that such cargo remains safely stowed and stationary during transit. The maritime transportation of cargo requires securing systems which include devices that can support and transfer the very high loads experienced as a result of the ship's dynamics and environmental conditions. In this regard, the deck of the ship typically include a plurality of cargo lashing fittings, often referred to as sockets or socket assemblies.

In certain applications, the size and weight of the cargo may require additional securing restraints beyond the typical lashing gear used to secure the cargo to the sockets located on the deck. One such application, involves the transportation of barges on a ship. More particularly, a barge (which may often be carrying its own cargo)—is loaded onto a ship for transportation. The size and weight of the barge (together with the secondary cargo being carried by the barge) often requires the need to use additional restraints during transit, particularly additional transverse restraints.

Because these additional transverse restraints are only required in certain applications, and because these applications can involve cargo (e.g., barges) of varying sizes and configurations, the mentioned additional transverse restraints should preferably be both removable from the ship when not in use, and readily adjustable to allow varying sized/configured cargo to be transversely restrained.

There is therefore a need in the art for a chocking system, which is both removable and readily adjustable, for providing additional transverse restraint to cargo during transit.

SUMMARY OF THE INVENTION

The present invention, which address the needs of the prior art, provides a barge chocking assembly for restraining transverse movement of a barge transported on a ship, the ship including a deck having support structure extending therefrom for carrying the barge. The barge chocking assembly includes first and second inboard chocking members for engaging the support structure of the ship. The barge chocking assembly further includes an outboard chocking member sized and configured to engage the outboard edge of the barge. The barge chocking assembly further includes first and second tensioning arms, each of the tensioning arms having a first end and a second end, the first end of the first tensioning arm being connected to the first chocking member, the first end of the second tensioning arm being connected to the second chocking member. The barge chocking assembly further includes first and second chock-support stands, each of the chock-support stands including a chock-engaging shoulder, the first chock-support stand supporting the second end of the first tensioning arm, the second chock-support stand supporting the second end of said second tensioning arm. The outboard chocking member is positioned between the chock-engaging shoulders of the chock-support stands and the outboard edge of the barge whereby transverse forces experienced by the barge are transferred through the tensioning arms to the ship via the inboard chocking members.

As a result, the present invention provides a chocking system, which is both removable and readily adjustable, for providing additional transverse restraint to cargo during transit.

DETAILED DESCRIPTION OF THE INVENTION

Figure 1:
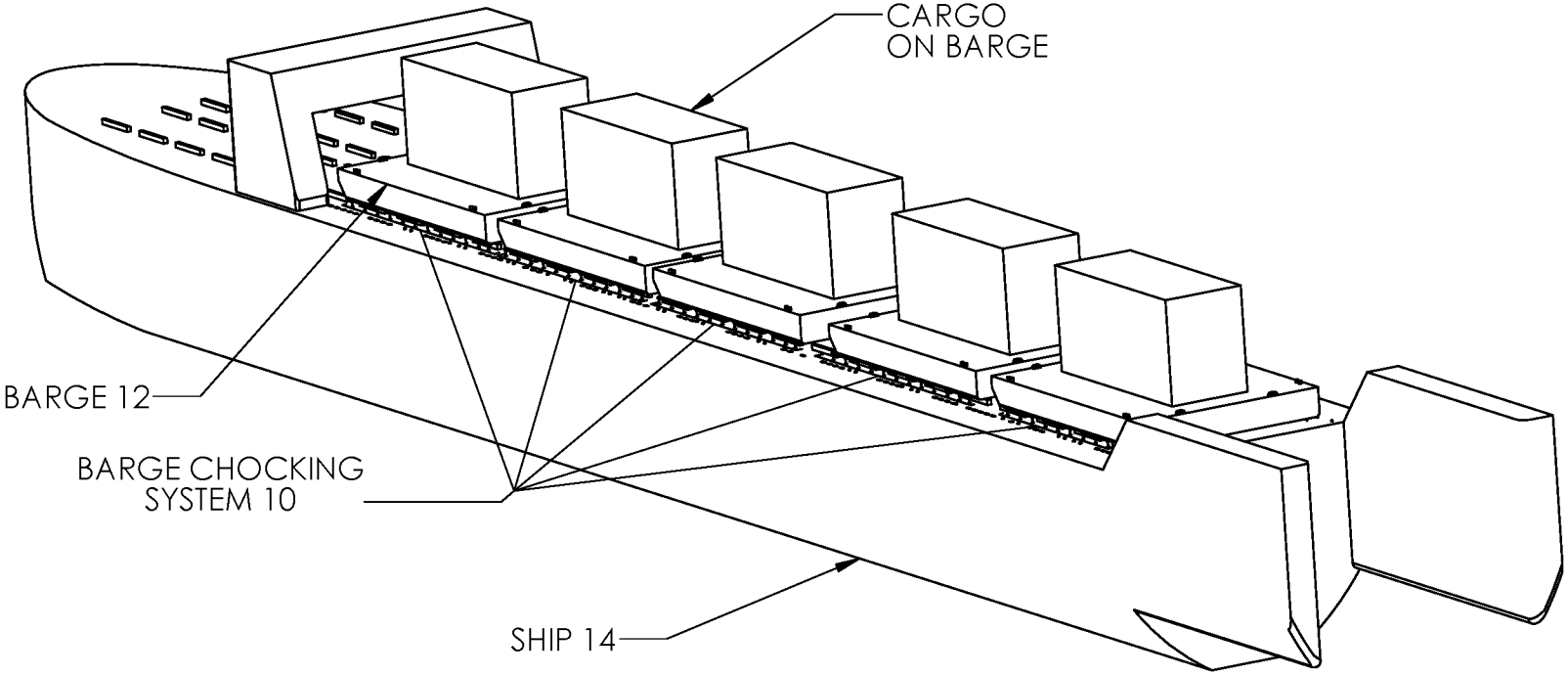
FIG. 1 is a perspective view showing the barge chocking system of the present invention providing additional transverse restraint to a barge being carried on a ship.
Figure 2:
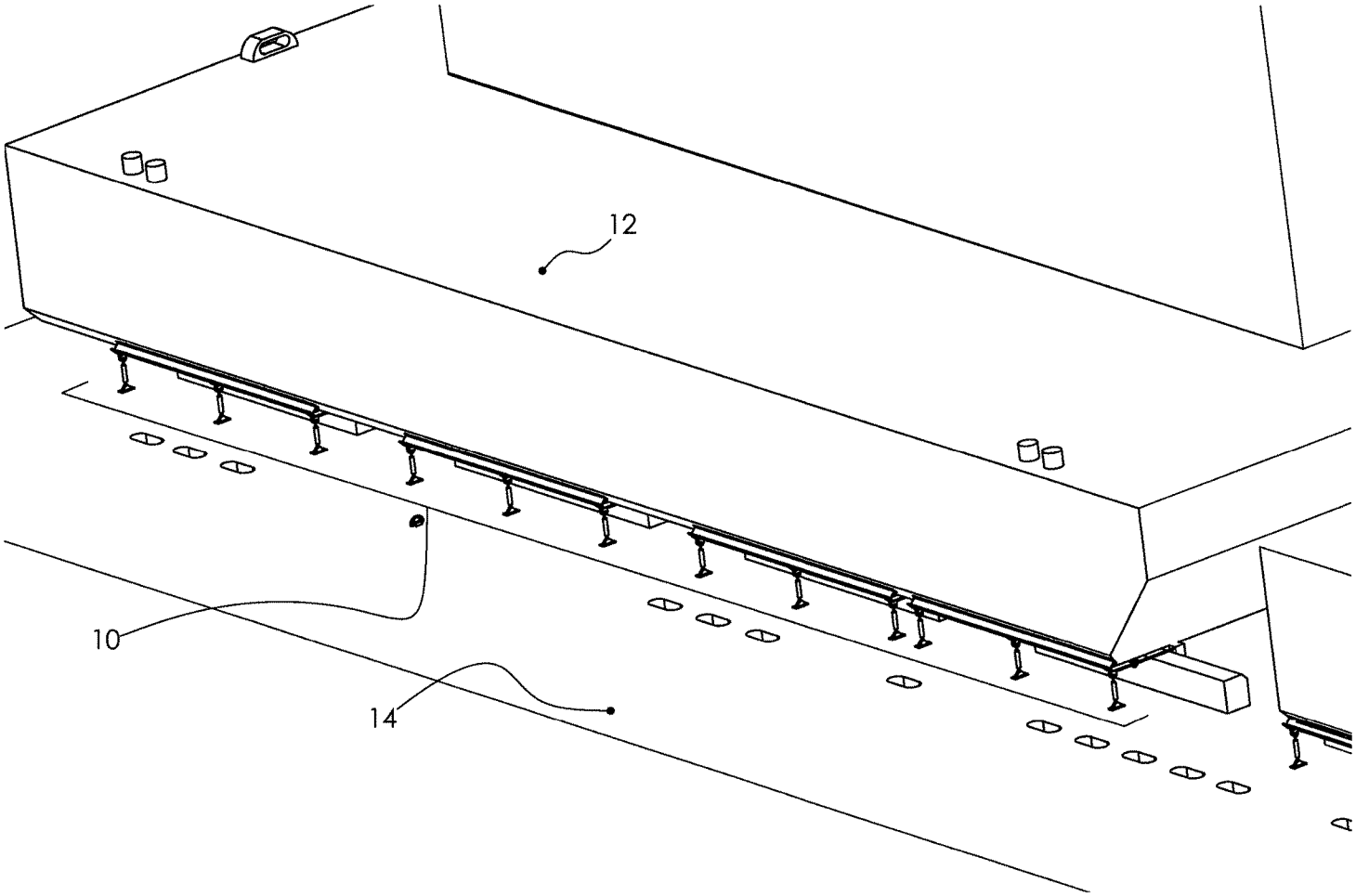
FIG. 2 is a an enlarged perspective view taken from FIG. 1.
Figure 3:
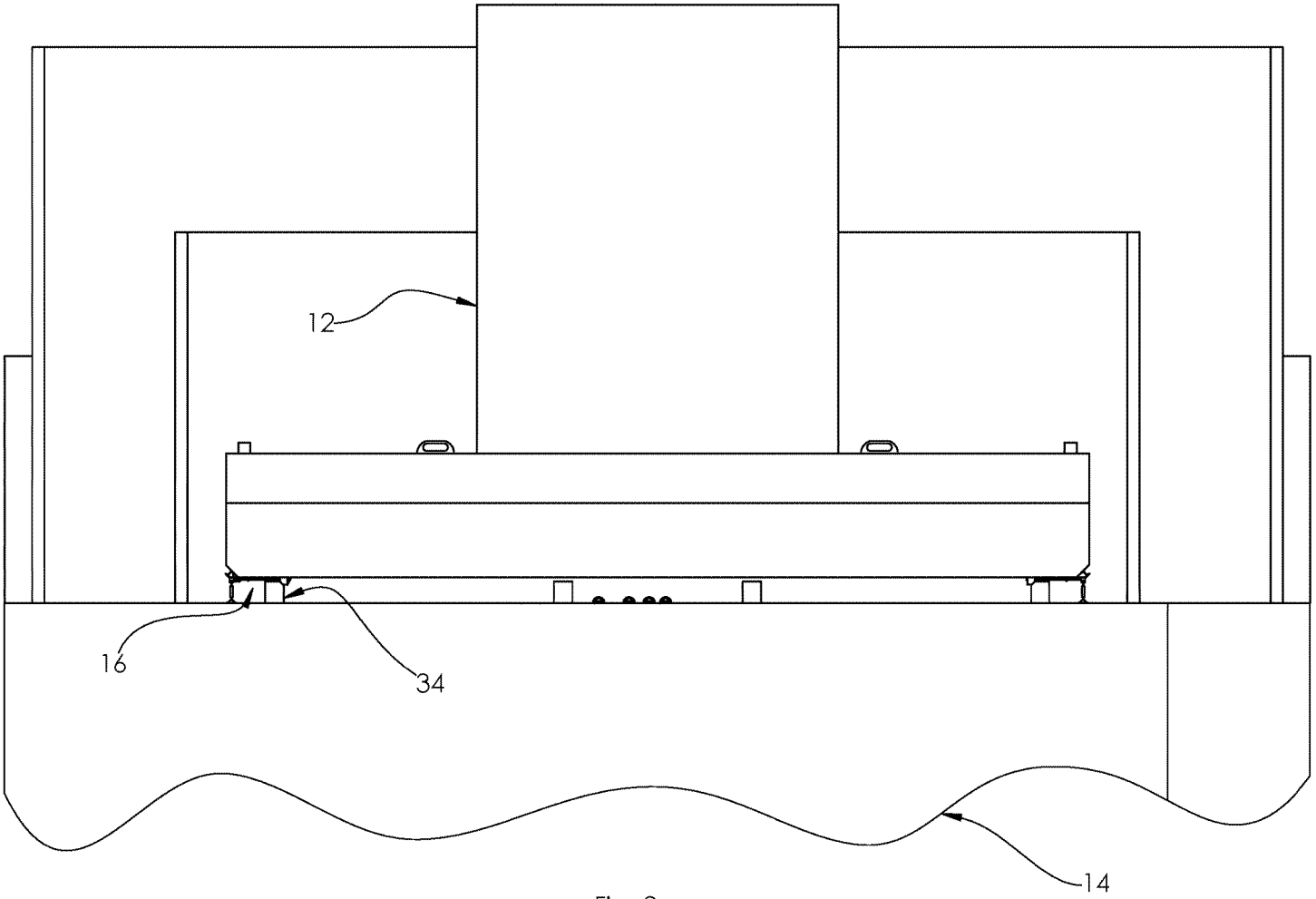
FIG. 3 is an end elevational view of the barge chocking system shown in FIG. 1.

Referring to FIGS. 1-5, the present invention provides a barge chocking system 10 for restraining transverse movement of a barge 12 transported on a ship 14. Normally, lashing gear (e.g., chains, wire rope assemblies, etc.) and friction provide sufficient restraint for safe transport. However, in cases where additional restraint is necessary to meet specific regulations or to provide an added safety factor, barge chocking system 10 can be utilized to provide the desired transverse restraint. Barge chocking system 10 is both adjustable (allowing for multiple and varied installations) and entirely removable when not in use.

Barge chocking system 10 includes 1 or more chocking assemblies 16. Each of assemblies 16 preferably includes inboard chocking members 18, an outboard chocking member 20, tensioning arms 22, and chock-support stands 24. In turn, each of chock-support stands 24 includes a height-adjustable leg 26, a locking arm 28, and a chock-engaging shoulder 30. The chocking members 18 preferably function as an interface between the barge 12 and the ship 14. The tensioning arms 22 provide the desired transverse restraint, while also allowing for adjustment to meet varying cargo specifications. The legs 26 of stands 24 provide vertical support of the outboard chock 20.

Figure 4:
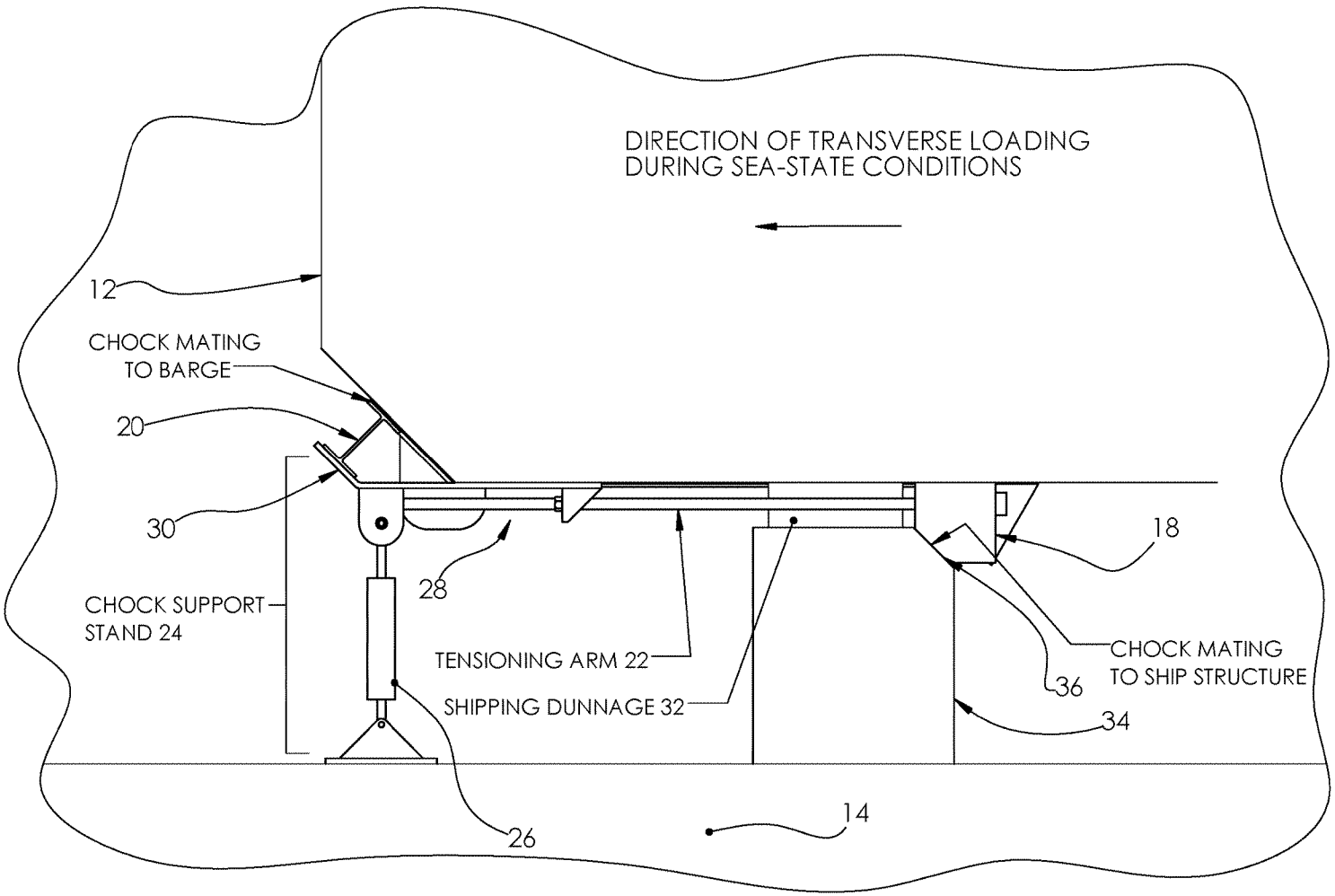
FIG. 4 is an enlarged detail taken from FIG. 3.
Figure 5:
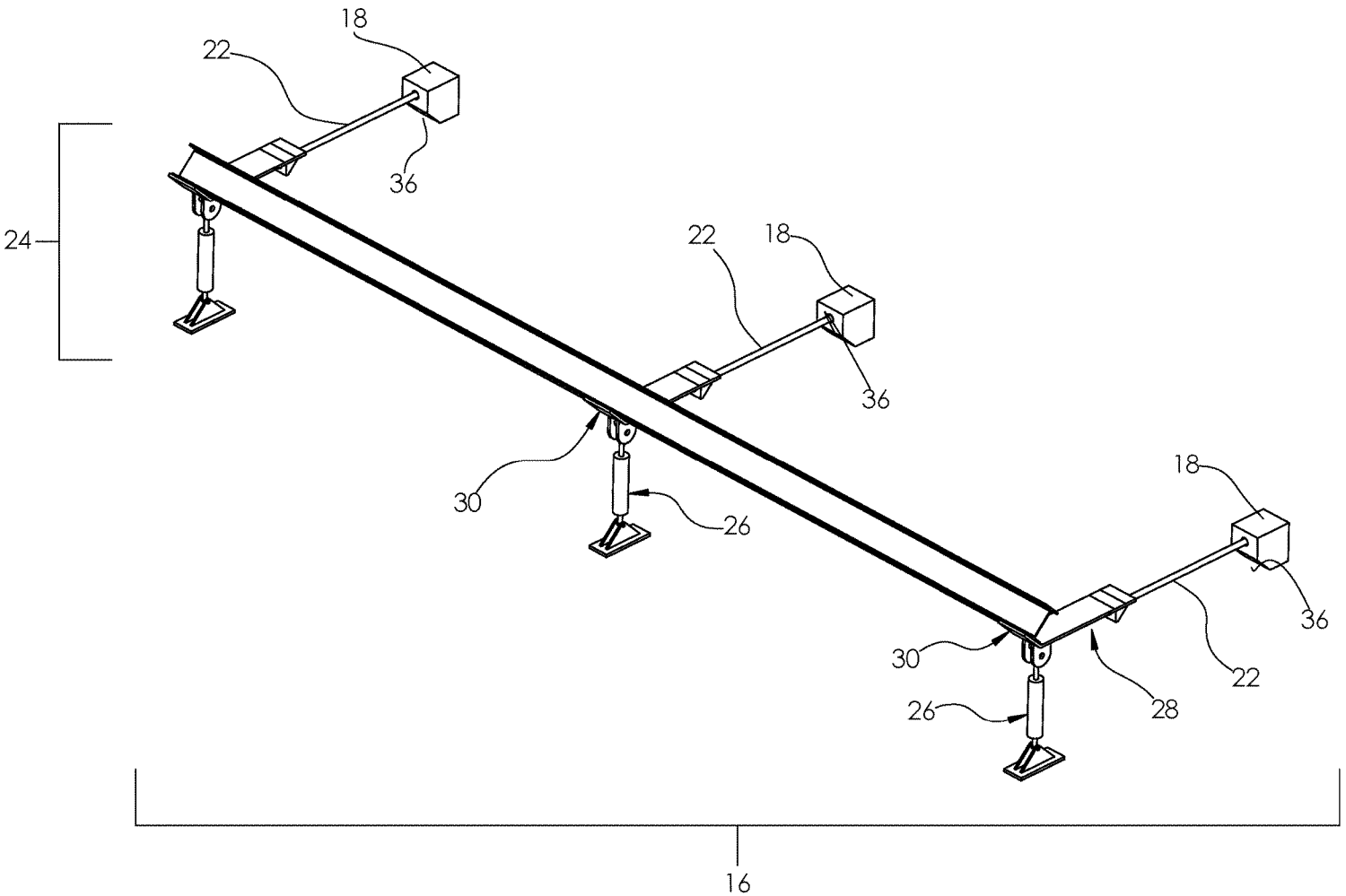
FIG. 5 is a perspective view showing the components of a barge chocking assembly away from the barge and ship of FIG. 1.

Dunnage boards 32 may be used in certain applications, as shown in FIG. 4. However, it is contemplated herein that barge chocking system may be used in other applications without the need for dunnage boards. In one embodiment, dunnage boards 32 are formed of wood having holes provided therethrough. This configuration allows the tensioning arms 22 to pass through the dunnage boards 32 so that the weight of barge 12 rests on the dunnage boards.

For installation and operation of barge chocking system 10, a plurality of chocking assemblies are pre-positioned with respect to a selected support structure 34 of ship 14. Dunnage boards 32 may or may not be required depending on the design and configuration of support structure 34. Once the desired number of chocking assemblies are pre-positioned, barge 12 is then moved into place and rested on dunnage boards 32, if utilized. At this point, the outboard chock 20 is positioned on chock-engaging shoulders 30 of stands 24. In one preferred embodiment, the chock-engaging shoulders are angularly adjustable to compensate for various sized/configured barges. The stands are then translated inboard until chock 20 is in contact with the outboard edge of barge 22. It is contemplated herein that outboard chock 20 may be secured to chock-engaging shoulders 30, either prior to or following loading of barge 12 on the ship 14. At this point, locking arms 28 of stands 24 are secured to tensioning arms 22, thereby providing a system for transverse restraint. In one preferred embodiment, tensioning arms telescopically slide within locking arms 28 to allow for lateral adjustment of the chock-support stands. In another preferred embodiment, chocking members 18 include at least one inclined surface 36 configured to frictionally engage support structure 34 of ship 14.

Although the embodiment of barge chocking system 10 disclosed herein utilizes three chocking assemblies 16, it is contemplated that barge chocking system 10 can be designed with any necessary/suitable number of chocking assemblies 16. Similarly, each of assemblies 16 can be designed to include any necessary/suitable number of chocks, tensioning arms and chock-support stands.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and/or deviations be included in the scope of the present invention.

What is claimed is:

1. A barge chocking assembly for restraining transverse movement of a barge transported on a ship, said ship including a deck having support structure extending therefrom for carrying said barge, said barge chocking assembly comprising:

first and second inboard chocking members for engaging said support structure of said ship;

an outboard chocking member sized and configured to engage the outboard edge of said barge;

first and second tensioning arms, each of said tensioning arms having a first end and a second end, said first end of said first tensioning arm being connected to said first chocking member, said first end of said second tensioning arm being connected to said second chocking member;

first and second chock-support stands, each of said chock-support stands including a chock-engaging shoulder, said first chock-support stand supporting said second end of said first tensioning arm, said second chock-support stand supporting said second end of said second tensioning arm;

and wherein said outboard chocking member is positioned between said chock-engaging shoulders of said chock-support stands and the outboard edge of said barge whereby transverse forces experienced by said barge are transferred through said tensioning arms to said ship via said inboard chocking members.

2. The barge chocking assembly according to claim 1, wherein each of said chock-support stands further includes:

a height-adjustable leg for adjusting the height of said chock-engaging shoulder with respect to said deck; and a locking arm configured for securement to one of said tensioning arms when said outboard chocking member is positioned on said chock-engaging shoulders and against the outboard edge of said barge.

3. The barge chocking assembly according to claim 2, wherein said tensioning arm telescopes within said locking arm of said chock-support stand.

4. The barge chocking assembly according to claim 2, wherein said chock-engaging shoulder is angularly adjustable to compensate for varying configured cargo.

5. The barge chocking assembly according to claim 2, wherein said inboard chocking member includes at least one inclined surface configured to frictionally contact said support structure of said ship.

6. The barge chocking assembly according to claim 2, further comprising:

a third inboard chocking member for engaging said support structure of said ship;

a third tensioning arm, said third tensioning arm having a first end and a second end, said first end of said third tensioning arms being connected to said third chocking member;

a third chock-support stand, said third chock-support stand including a chock-engaging shoulder, said third chock-support stand supporting said second end of said third tensioning arm.

7. A barge chocking system for restraining transverse movement of a barge transported on a ship, said ship including a deck having support structure extending therefrom for carrying said barge, said barge chocking system comprising:

a first chocking assembly including:

first and second inboard chocking members for engaging said support structure of said ship;

a first outboard chocking member sized and configured to engage the outboard edge of said barge;

first and second tensioning arms, each of said tensioning arms having a first end and a second end, said first end of said first tensioning arm being connected to said first chocking member, said first end of said second tensioning arm being connected to said second chocking member;

first and second chock-support stands, each of said chock-support stands including a chock-engaging shoulder, said first chock-support stand supporting said second end of said first tensioning arm, said second chock-support stand supporting said second end of said second tensioning arm; and wherein said first outboard chocking member is positioned between said chock-engaging shoulders of said first and second chock-support stands and the outboard edge of said barge whereby transverse forces experienced by said barge are transferred through said tensioning arms to said ship via said first and second inboard chocking members;

a second chocking assembly including:

third and fourth inboard chocking members for engaging said support structure of said ship;

a second outboard chocking member sized and configured to engage the outboard edge of said barge;

third and fourth tensioning arms, each of said tensioning arms having a first end and a second end, said first end of said third tensioning arm being connected to said third chocking member, said first end of said fourth tensioning arm being connected to said fourth chocking member;

third and fourth chock-support stands, each of said chock-support stands including a chock-engaging shoulder, said third chock-support stand supporting said second end of said third tensioning arm, said fourth chock-support stand supporting said second end of said fourth tensioning arm; and wherein said second outboard chocking member is positioned between said chock-engaging shoulders of said third and fourth chock-support stands and the outboard edge of said barge whereby transverse forces experienced by said barge are transferred through said tensioning arms to said ship via said third and fourth inboard chocking members.

8. The barge chocking system according to claim 7, wherein each of said chock-support stands further includes:

a height-adjustable leg for adjusting the height of said chock-engaging shoulder with respect to said deck; and a locking arm configured for securement to one of said tensioning arms when said outboard chocking member is positioned on said chock-engaging shoulders and against the outboard edge of said barge.

9. The barge chocking system according to claim 8, wherein said tensioning arm telescopes within said locking arm of said chock-support stand.

10. The barge chocking system according to claim 8, wherein said chock-engaging shoulder is angularly adjustable to compensate for varying configured cargo.

11. The barge chocking system according to claim 8, wherein said inboard chocking member includes at least one inclined surface configured to frictionally contact said support structure of said ship.

* * * * *